US008033279B2

(12) United States Patent
Shaffer

(10) Patent No.: US 8,033,279 B2
(45) Date of Patent: Oct. 11, 2011

(54) BURNER CONTROL SYSTEM FOR A COOKING APPLIANCE

(75) Inventor: Timothy Scott Shaffer, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 235 days.

(21) Appl. No.: 12/277,318

(22) Filed: Nov. 25, 2008

(65) Prior Publication Data

US 2010/0126495 A1 May 27, 2010

(51) Int. Cl.
*F24C 3/00* (2006.01)

(52) U.S. Cl. ..... 126/39 N; 126/1 R; 137/614

(58) Field of Classification Search ..... 126/1 R, 126/39 N; 137/614
See application file for complete search history.

(56) References Cited

U.S. PATENT DOCUMENTS 1,530,002 A * 3/1925 Lange ..... 126/39 J
1,962,251 A * 6/1934 Magin ..... 126/39 N
2,008,911 A * 7/1935 Hodgkin et al. ..... 137/635
2,025,276 A * 12/1935 Drezdon ..... 431/280
2,032,884 A * 3/1936 Mohlman ..... 337/384
2,033,369 A * 3/1936 Baker ..... 126/39 N
2,043,106 A * 6/1936 Lange ..... 137/556
2,109,497 A * 3/1938 Marvin et al. ..... 431/193
2,304,140 A * 12/1942 Bergholm ..... 126/39 G
2,475,425 A * 7/1949 Duclos et al. ..... 236/69
2,573,502 A * 10/1951 Smith, Jr. ..... 431/280
2,619,162 A * 11/1952 Feilden ..... 60/740
2,765,809 A * 10/1956 Lamar ..... 137/625.12
3,632,982 A * 1/1972 Linger ..... 219/448.17
3,733,027 A 5/1973 Napier
3,976,243 A * 8/1976 Christophel ..... 236/6
4,607,609 A 8/1986 Keating
4,614,491 A * 9/1986 Welden ..... 431/60
4,634,843 A 1/1987 Payne
4,754,744 A * 7/1988 Borg ..... 126/39 N
5,099,822 A * 3/1992 Cramer et al. ..... 126/39 BA
5,795,145 A * 8/1998 Manning et al. ..... 431/280
5,829,425 A * 11/1998 Woods et al. ..... 126/39 E
5,836,296 A * 11/1998 Hillis et al. ..... 126/39 G
5,851,110 A * 12/1998 Ridenour ..... 431/278
5,915,952 A * 6/1999 Manning et al. ..... 431/12
5,937,847 A * 8/1999 Garceau et al. ..... 126/39 H
6,017,211 A * 1/2000 Gort et al. ..... 431/266
6,062,211 A * 5/2000 Thomas et al. ..... 126/512
6,068,471 A * 5/2000 Ridenour ..... 431/278
7,096,887 B2 * 8/2006 Tupa et al. ..... 137/625.47
7,255,100 B2 * 8/2007 Repper et al. ..... 126/39 BA
7,467,639 B2 * 12/2008 Watson et al. ..... 137/1
2005/0178450 A1 * 8/2005 Tupa et al. ..... 137/625.47
2006/0147861 A1 * 7/2006 Czajka et al. ..... 431/278
2007/0048683 A1 * 3/2007 Huff ..... 431/281
2007/0113838 A1 5/2007 Czajka et al.
2007/0235020 A1 * 10/2007 Hills et al. ..... 126/512
2010/0001087 A1 * 1/2010 Gum ..... 237/2 A
2010/0200565 A1 * 8/2010 Leung et al. ..... 219/443.1

FOREIGN PATENT DOCUMENTS

GB 2292453 A * 2/1996

* cited by examiner

*Primary Examiner* — Kenneth Rinehart
*Assistant Examiner* — Jorge Pereiro
(74) *Attorney, Agent, or Firm* — Global Patent Operation; Douglas D. Zhang

(57) ABSTRACT

An appliance including at least two surface burners and a burner control system configured to selectively allow individual control of each of the at least two burners or simultaneous control of the at least two burners as a unit.

15 Claims, 7 Drawing Sheets

BURNER CONTROL SYSTEM FOR A COOKING APPLIANCE

BACKGROUND OF THE INVENTION

The exemplary embodiments of the present invention generally relate to cooking appliances. More particularly, the exemplary embodiments relate to simultaneous control of two or more heating elements of a cooking appliance.

Griddles for cooking appliances such as stoves and cooktops may be placed over multiple heating elements of the cooking appliance. Generally, a user independently adjusts each of the multiple heating elements in an attempt to balance out the heat applied to the griddle by the heating elements. Detection of the heat distribution across the griddle is generally performed through some sensory feedback, such as visual heat indications (e.g., charring, boiling, smoking, etc. of the items being cooked). Adjustments to the individual heating elements may be made continually based on the user's sensory feedback. Achieving a uniform heat distribution across the griddle is generally difficult to achieve and/or detect through the independent adjustment of the heating elements.

BRIEF DESCRIPTION OF THE INVENTION

As described herein, the exemplary embodiments overcome one or more of the above or other disadvantages known in the art.

One aspect of the exemplary embodiments relates to an appliance. The appliance includes a cooktop having at least two burners and a burner control system configured to selectively allow individual control of each of the at least two burners or simultaneous control of the at least two burners as a unit.

Another aspect of the exemplary embodiments relates to a burner control system for a cooking appliance. The burner control system includes a griddle zone including a first burner and a second burner, a first valve configured to individually meter a flow of gas to the first burner, a second valve configured to individually meter a flow of gas to the second burner, and a third valve configured to meter a flow of gas to both of the first burner and the second burner independent of the first valve and the second valve.

Still another aspect of the exemplary embodiments relates to a burner control system for a gas operated cooking appliance. The burner control system includes a griddle zone having multiple burners, and a valve system for controlling a flow of gas to each of the multiple burners. The valve system is configured to selectively allow individual control of each of the multiple burners or simultaneous control of the multiple burners as a unit.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
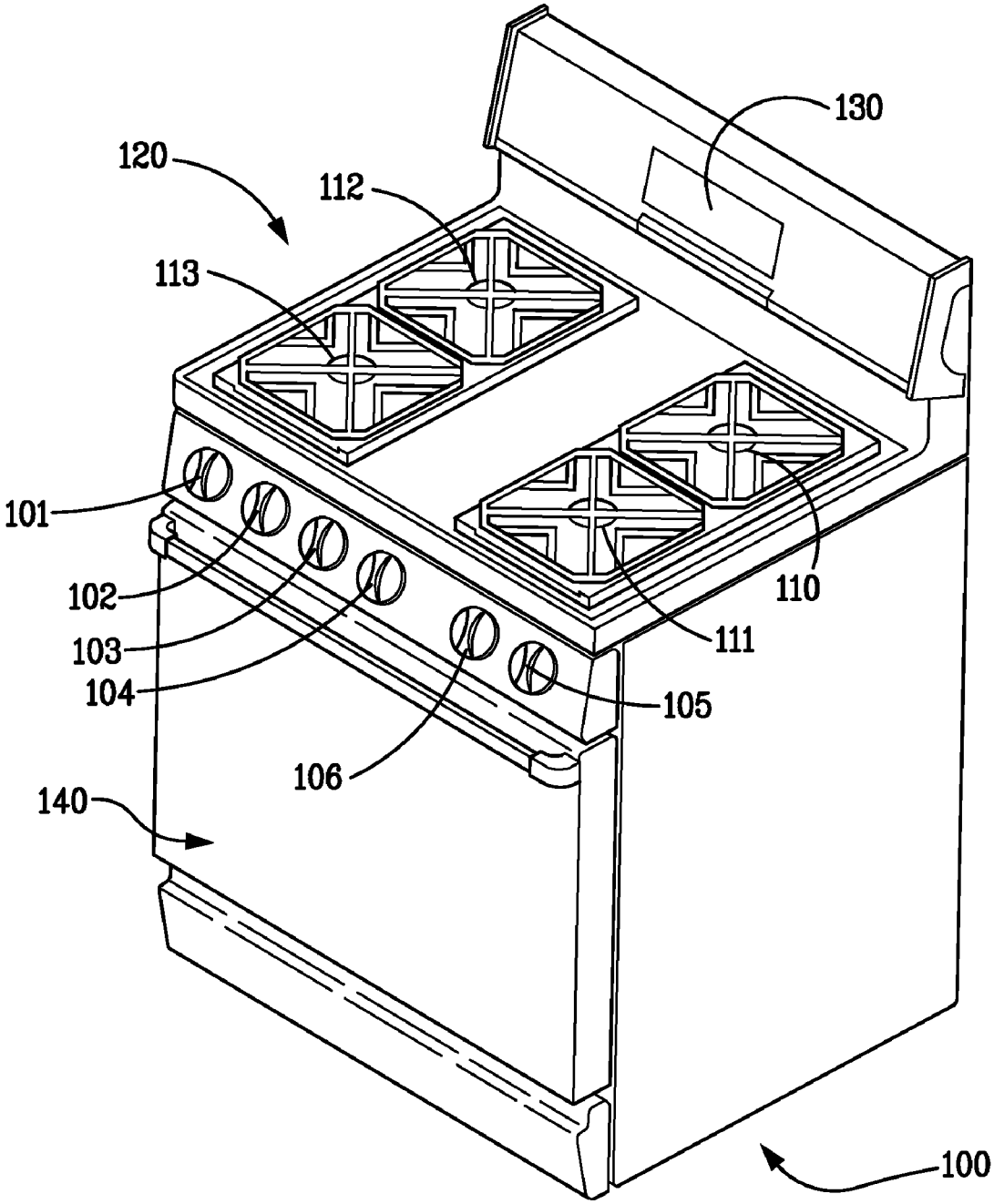
FIGS. 1 and 2 are schematic illustrations of an exemplary appliance incorporating features of an exemplary embodiment.

FIG. 1 illustrates an exemplary cooking appliance 100 in accordance with an exemplary embodiment. In this example, the cooking appliance 100 is shown as a range but in alternate embodiments the cooking appliance may be, for example, any suitable cooking appliance having individually operable surface burners including, but not limited to, cabinet mounted cooktops and portable grilling units. The cooking appliance 100 may include a cooktop 120 having two or more surface burners 110-113, an oven 140, one or more control knobs 101-106 and a display 130. The burners 110-113 may be any suitable burners such as, for example, gas operated burners having any suitable heat rating. The burners 110-113 may all have the same heat rating or one or more of the burners 110-113 may have a heat rating different from heat ratings of the other burners. The control knobs 101-106 (or any other suitable analog or digital user interface) may be configured to allow operation of a respective valve for controlling a flow of gas to a respective one of the burners 110-113 or oven 140. The display 130 may be configured to present any suitable information related to the operation of the cooking appliance 100.

Figure 2:
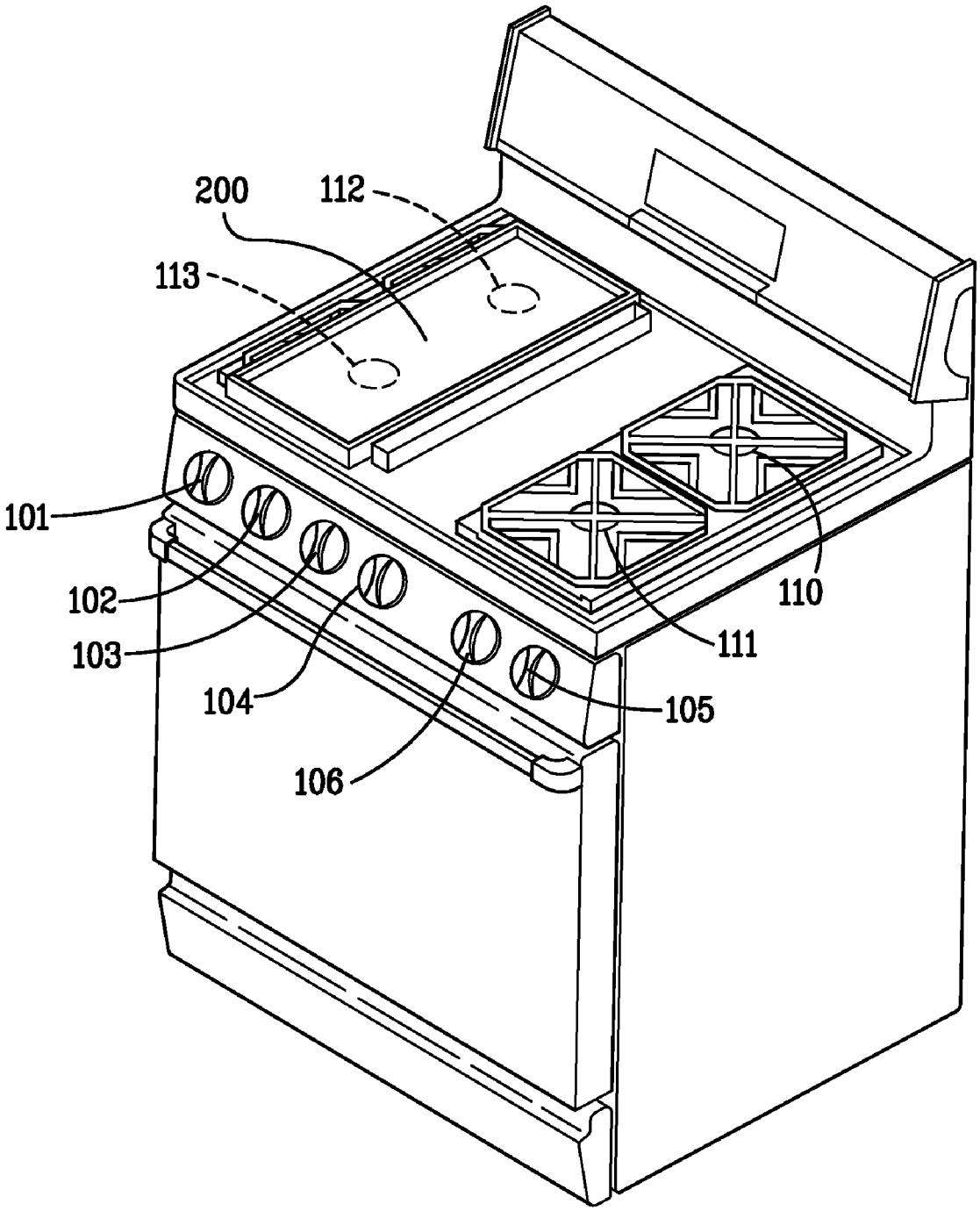

The exemplary embodiments provide for the simultaneous control of two or more burners as a unit (e.g., effectively operated or controlled as a single burner) using a single control. For example, referring now to FIG. 2, a griddle 200 may be placed over the burners 112, 113. While each of these burners 112, 113 may be individually operated through their respective control knobs 101, 102, providing a substantially uniform heat gradient across the griddle 200 may prove difficult through separate control of the burners 112, 113. In accordance with the exemplary embodiments, an additional control knob is provided to alternately simultaneously control burners 112, 113 as a unit so that a substantially uniform heat gradient is applied across the cooking surface of the griddle 200 regardless of a respective heat rating of each burner.

Figure 3:
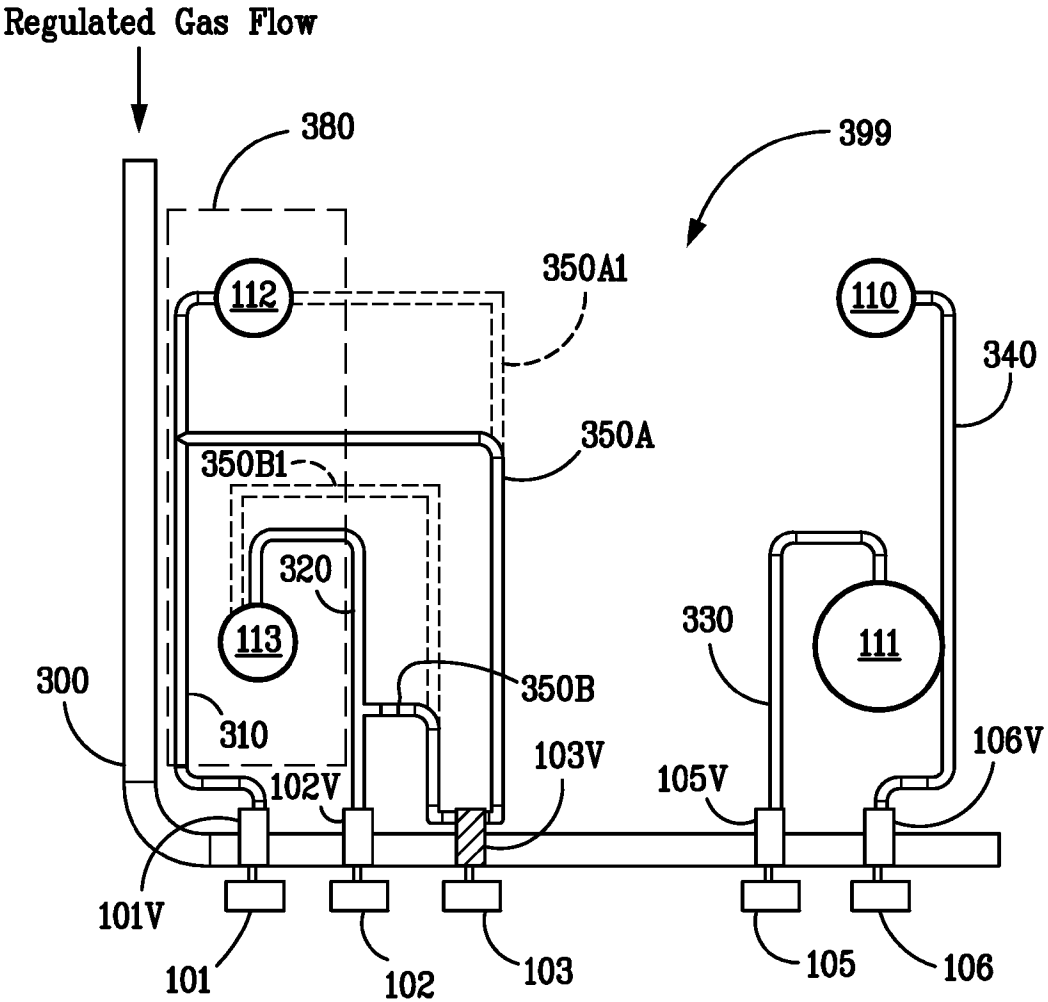
FIGS. 3-5 are schematic illustrations of a portion of exemplary burner control systems of the appliance in FIGS. 1 and 2.

An exemplary burner control system 399 is illustrated in FIG. 3. The burner control system 399 is shown for exemplary purposes only and in alternate embodiments the burner control system 399 may include any suitable components or have any suitable configuration for simultaneously controlling two or more burners. In this example, two of the four burners shown may be simultaneously controlled as described below to form a griddle zone 380. In other examples, more than two burners may be simultaneously controlled. The burner control system 399 includes a gas header pipe 300 for providing a regulated flow of gas from any suitable fuel source to the burner control system 399. One or more gas valves 101V, 102V, 105V, 106V may be communicably connected to the gas header pipe for selectively metering a flow of gas to a respective one of the burners 110-113. Each of the gas valves 101V, 102V, 105V, 106V may be controlled through a respective control knob 101,102,105, 106 or other suitable user interface. The control knob 104 and the associated valve for the oven 140 are not shown in FIGS. 3-5 for clarity.

In accordance with the exemplary embodiment, an amount of gas flowing to the first burner 110 may be individually controlled through the control knob 106. An amount of gas flowing to the second burner 111 may be individually controlled through the control knob 105. An amount of gas flowing to the third burner 112 may be individually controlled through the control knob 101. An amount of gas flowing to the fourth burner 113 may be individually controlled through the control knob 102. In this regard, branch lines 310, 320, 330, 340 fluidly connect the burners 112, 113, 111, 110 to the valves 101V, 102V, 105V, 106V, respectively, for providing the flow of gas to the respective burners 112, 113, 111, 110.

A flow of gas may also be directed by the burner control system 399 so that the burners 112, 113 are simultaneously controlled as a unit for forming a griddle zone 380. For example, a valve 103V for simultaneously controlling the burners 112, 113 is controlled through the control knob 103 or any other suitable user interface. The valve 103V may be configured for simultaneously metering a flow of gas to both the third burner 112 and the fourth burner 113 so that each burner produces a substantially identical or balanced amount of heat regardless of the burner heat ratings for substantially uniformly heating a surface of a griddle such as the griddle 200 shown in FIG. 2. In this exemplary embodiment, a branch line 350B fluidly connects the valve 103V to the branch line 320 for feeding the fourth burner 113 and a branch line 350A fluidly connects the valve 103V to the branch line 310 for feeding the third burner 112. While the connections between the branch lines 350A, 350B from the valve 103V to the respective branch lines 310, 320 are shown as "T" type connections (e.g., the connection forms the shape of the letter "T"), in alternate embodiments the connections between the branch lines may be any suitable connections having any suitable configuration. The connections between the branch lines 350B and 320 as well as the connection between the branch lines 350A and 310 may be configured such that there is no cross flow of gas between the burners 112, 113 when each burner 112, 113 is individually operated. For example, the valve 103V may be configured with two outlet ports (e.g., one port for each of branch lines 350A, 350B) where the ports are sealed off from one another when the valve 103V is closed and are in flow communication with each other when the valve 103V is opened. In alternate embodiments, suitable check valves or other flow directing devices may be provided in the branch lines 350A, 350B and/or the valve 103V to prevent a flow of gas between the branch lines 310 and 320 when each burner 112, 113 is individually operated for preventing a cross flow of gas between the burners 112, 113. In other exemplary embodiments, the branch lines 350A, 350B may not connect to branch lines 310, 320. For example, as shown in dashed lines in FIG. 3, the branch lines 350A1, 350B1 may directly supply a flow of gas to the third and fourth burners 112,113 respectively, without connecting to the branch lines 310, 320.

Figure 4:
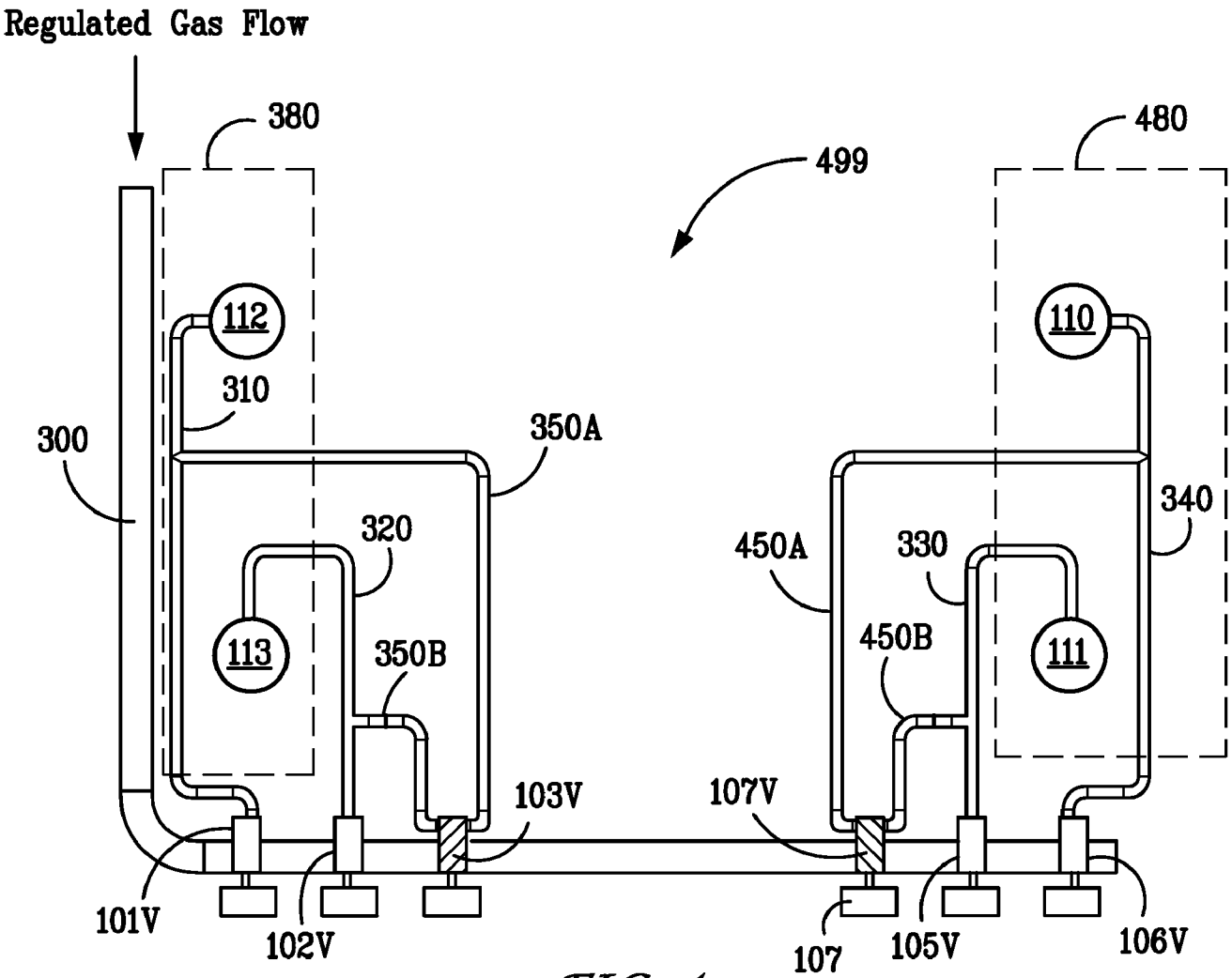

FIG. 4 illustrates another exemplary burner control system 499 in accordance with an exemplary embodiment. The burner control system 499 may be substantially similar to the burner control system 399 shown in FIG. 3 unless otherwise noted. In this example, the burner control system 499 forms two griddle zones 380, 480. The burner control system 499 includes an additional valve 107V and control knob 107 substantially similar to the valve 103V and the control knob 103. In one exemplary embodiment, a branch line 450A fluidly connects the valve 107V with the branch line 340 for feeding the first burner 110 and a branch line 450B fluidly connects the valve 107V with the branch line 330 for feeding the second burner 111. In other exemplary embodiments, the branch lines from the valve 107V may feed the first and second burners 110, 111 directly without connecting to the branch lines 330, 340. As described above with respect to FIG. 3, the valve 107V simultaneously meters a flow of gas to both of the first and second burners 110, 111 so that the burners 110, 111 produce a substantially identical or balanced amount of heat regardless of the burner heat ratings for substantially uniformly heating a surface of a griddle such as the griddle 200.

Figure 5:
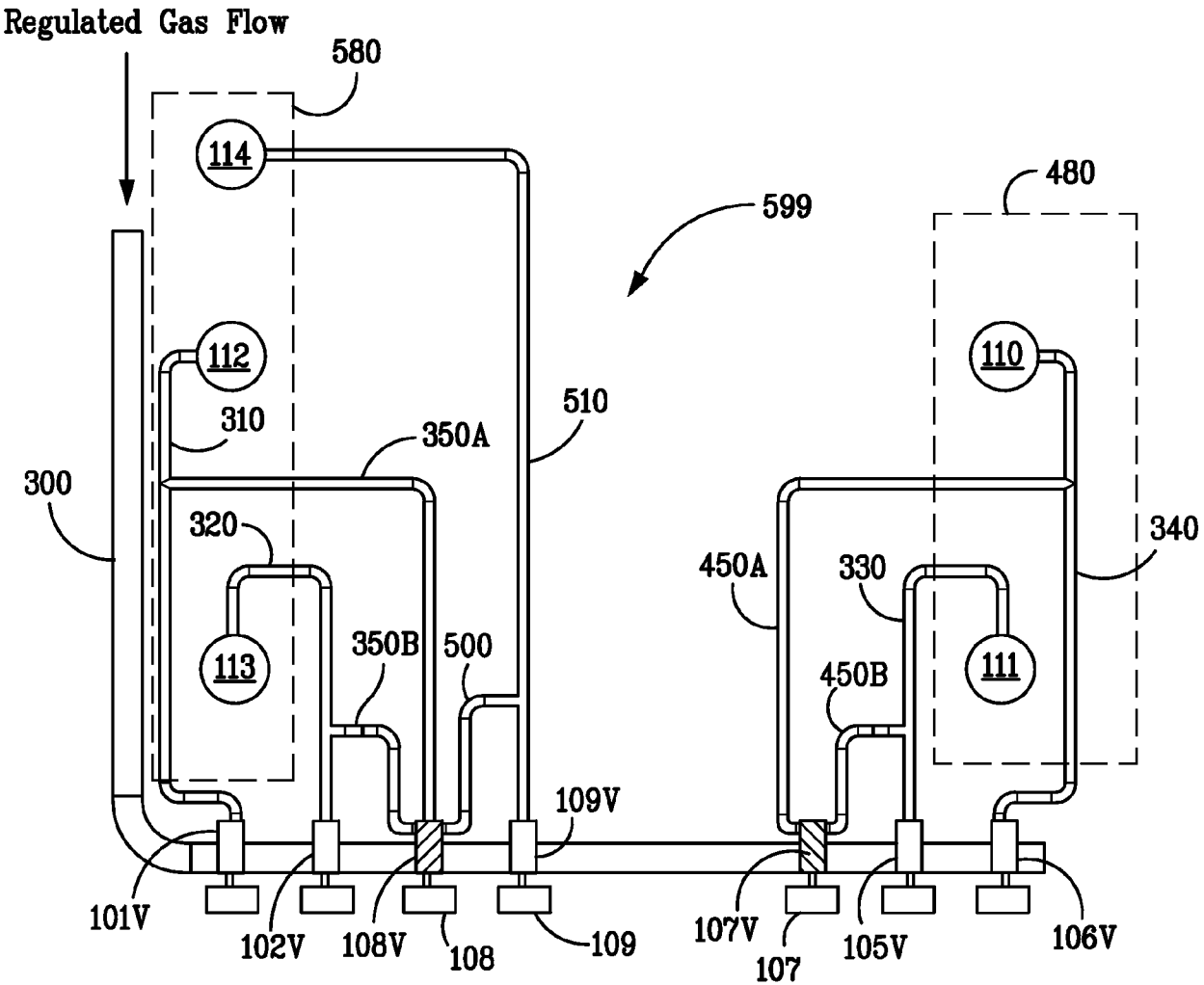

FIG. 5 illustrates another exemplary burner control system 599, which has two griddle zones 580, 480 with the griddle zone 580 including three burners 112, 113, 114. In this example, an additional valve 109V and control knob 109 (which may be substantially similar to the valve 101V and the control knob 101) are connected to the gas header pipe 300 for individually metering a flow of gas to a fifth burner 114. The valve 108V and the control knob 108 may be substantially similar to the valve 103V and the control knob 103 shown in FIG. 3. However, in this example, the valve 108V includes three outlet ports. Branch lines 350A, 350B, 500 are fluidly connected to the outlet ports of the valve 108V for simultaneously metering a flow of gas respectively to the branch lines 310, 320, 510. The simultaneous metering of the flow of gas to the branch lines 310, 320, 520 allows for a substantially identical or balanced production of heat from the burners 112, 113, 114 for substantially uniformly heating a surface of a griddle such the griddle 200 shown in FIG. 2.

Figure 7:
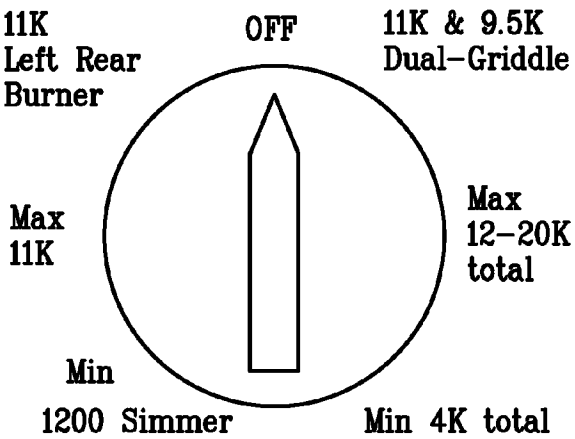
FIG. 7 is a front view of the bridge knob and its schedule that can be used in the burner control system shown in FIG. 6.
Figure 6:
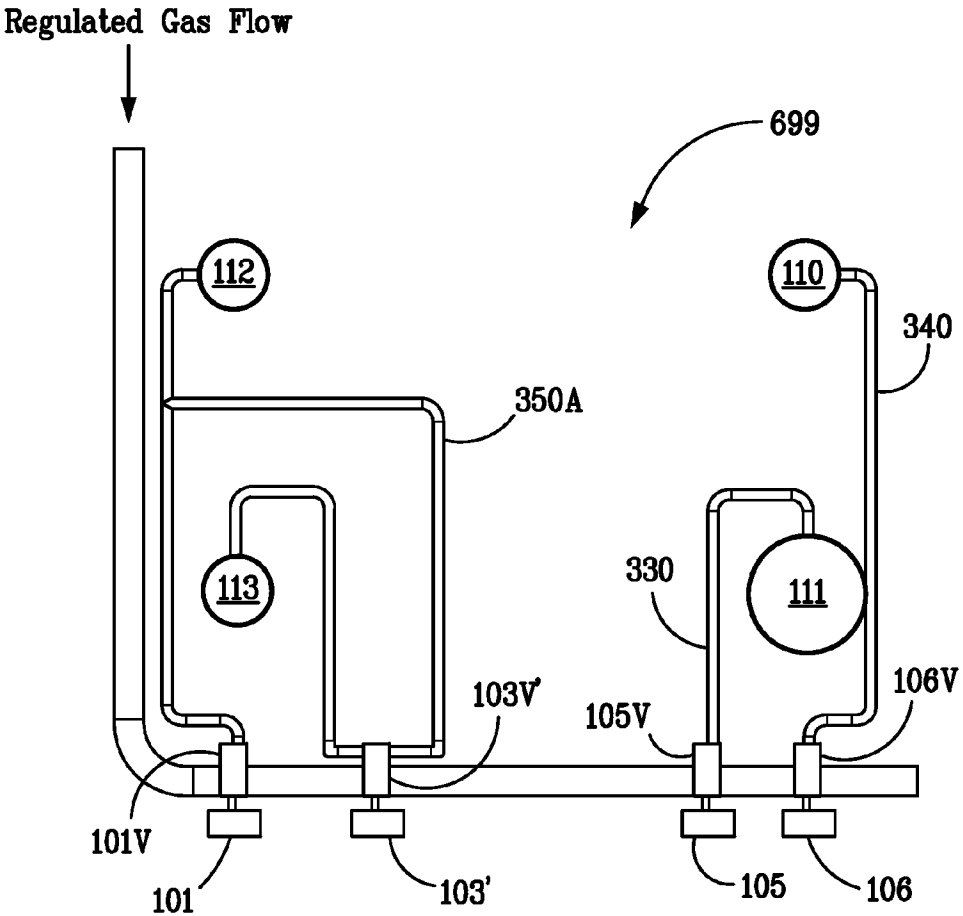
FIG. 6 is a schematic illustration of a portion of another exemplary burner control system of the appliance in FIGS. 1 and 2.

Another exemplary burner control system 699 is shown in FIG. 6. Compared with the burner control system 399 shown in FIG. 3, the control knob 102 and the valve 102V associated therewith are eliminated. Instead, a bridge control knob 103' and an associated valve 103V' are used. The valve 103V' is configured so that when the bridge control knob 103' is turned counterclockwise from its initial position (when viewed from FIG. 7), the valve 103V' meters or allows an amount of gas to flow to the burner 113 only; however, when the bridge control knob 103' is turned clockwise from its initial position, the valve 103V' meters or allows substantially equal amount of gas to flow to each of the burners 112, 113 simultaneously. Of course, the valve 103V' and the bridge control knob 103's can also be used to modify the burner control systems 499, 599.

Figure 8:
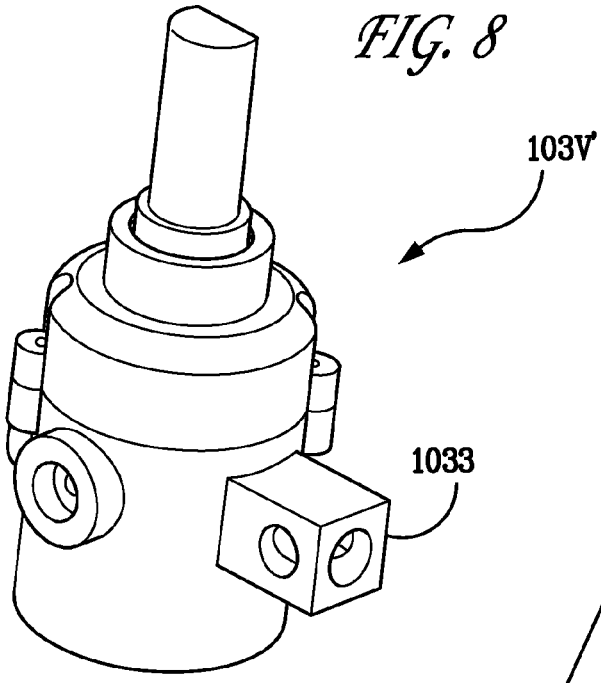
FIG. 8 is a perspective view of an exemplary valve 103V' shown in FIG. 6.
Figure 9:
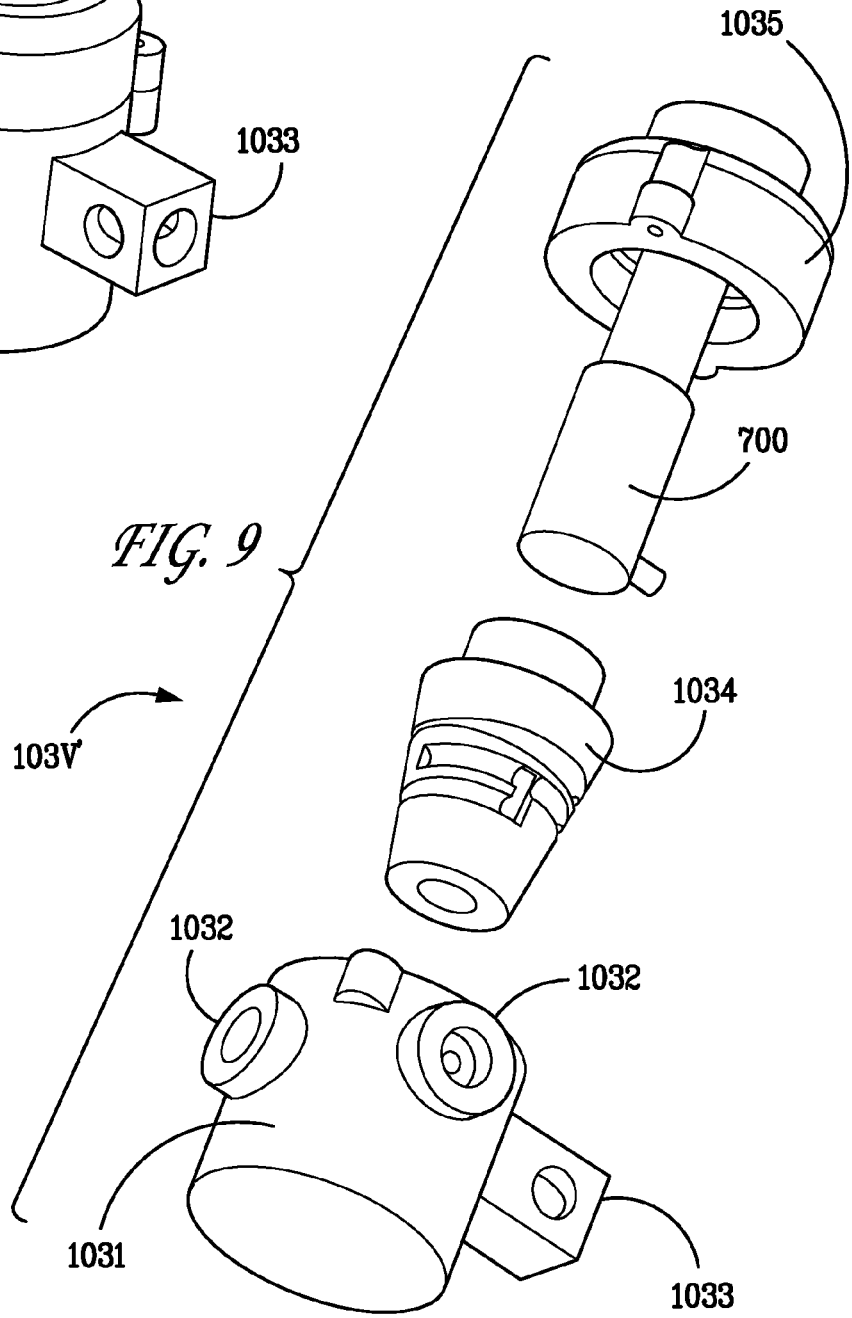
FIG. 9 is an exploded view of the valve 103V' of FIG. 8.

An exemplary valve 103V' is shown in FIGS. 8 and 9. The valve 103V' includes a valve body 1031 having two outlets 1032 and an inlet/manifold interface 1033, a rotating member 1034 which is rotatably received in the valve body 1031, and a cap 1035. A stem 700 is non-rotatably connected to the rotating member 1034 and extends outward to be connected to the bridge control knob 103'. The rotating member 1034 defines therein a cavity and connecting channels on its periphery surface so that when it is turned or rotated in one direction from its initial position, gas is supplied to the burner 113 only through one of the outlets 1032, and when it is turned in the other direction from its initial position, gas is supplied to both burners 112, 113 through the respective outlets 1032.

The above exemplary embodiments provide one or more additional controls for simultaneously metering gas flow to two or more burners. These one or more additional controls can be easily adjusted so each burner produces a substantially equal amount of heat for substantially uniformly heating a griddle placed over the two or more burners. The construction of the burner control system 399 is such that there is substantially no cross flow of gas between the two or more burners when the burners are being used individually.

Thus, while there have been shown and described and pointed out fundamental novel features of the invention as applied to the exemplary embodiments thereof, it will be understood that various omissions and substitutions and changes in the form and details of devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

a cooktop having at least two gas burners; and a burner control system comprising:

a first valve configured to individually control one of the at least two gas burners;

a second valve configured to individually control another of the at least two gas burners independently of the first valve; and a third valve configured to simultaneously control the at least two gas burners as a unit.

2. The appliance of claim 1, wherein the simultaneous control of the at least two gas burners effects a substantially balanced heat production between the at least two gas burners regardless of a heat rating of each of the at least two gas burners.

3. The appliance of claim 1, wherein the at least two gas burners comprise a first burner and a second burner, the first valve being configured to individually meter a flow of gas to the first burner, the second valve being configured to individually meter a flow of gas to the second burner, and the third valve being configured to meter a flow of gas to both of the first burner and the second burner independent of the first valve and the second valve.

4. The appliance of claim 3, wherein the third valve is further configured to prevent a crossflow of gas between the first burner and the second burner when the first burner and the second burner are individually controlled.

5. The appliance of claim 1, wherein the simultaneous control of the at least two gas burners effects a balanced amount of heat produced by the at least two gas burners for substantially uniformly heating a griddle placed on the at least two gas burners.

6. A burner control system for a gas operated cooking appliance, the burner control system comprising:

a griddle zone comprising multiple burners; and a valve system for controlling a flow of gas to each of the multiple burners, wherein the valve system comprises:

a first valve configured to individually control a first burner of the multiple burners;

a second valve configured to individually control a second burner of the multiple burners independently of the first valve; and a third valve configured to simultaneously control the multiple burners as a unit.

7. The burner control system of claim 6, wherein the simultaneous control of the multiple burners effects a substantially balanced heat production between the multiple burners regardless of a heat rating of each of the multiple burners.

8. The burner control system of claim 6, wherein the first valve is configured to individually meter a flow of gas to the first burner, the second valve is configured to individually meter a flow of gas to the second burner, and the third valve is configured to simultaneously meter a flow of gas to both of the first burner and the second burner independent of the first valve and the second valve.

9. The burner control system of claim 8, wherein the third valve is further configured to prevent a crossflow of gas between the first burner and the second burner via the third valve when the first burner and the second burner are individually controlled.

10. The burner control system of claim 6, wherein the simultaneous control of the multiple burners effects a balanced amount of heat produced by the multiple burners for substantially uniformly heating a griddle placed on the multiple burners.

11. A burner control system for a cooking appliance, the burner control system comprising:

a griddle zone comprising a first burner and a second burner;

a first valve configured to individually meter a flow of gas to the first burner via a first branch line;

a second valve configured to individually meter a flow of gas to the second burner via a second branch line independently of the first valve; and a third valve configured to meter a flow of gas to the first burner and the second burner via a third branch line and a fourth branch line, respectively, independent of the first valve and the second valve.

12. The burner control system of claim 11, wherein the third valve selectively effects simultaneous operation of the first burner and the second burner for producing a substantially balanced heat gradient across the griddle zone regardless of an individual heat rating of each of the first burner and the second burner.

13. The burner control system of claim 11, wherein the third valve is configured such that a crossflow of gas between the first burner and the second burner through the third valve is prevented when the first burner and the second burner are individually operated.

14. The burner control system of claim 11, wherein the third branch line is fluidly connected to the first branch line, and the fourth branch line is fluidly connected to the second branch line.

15. The burner control system of claim 11, wherein the third branch line is fluidly connected to the first burner directly, and the fourth branch line is fluidly connected to the second burner directly.

* * * * *